US005937226A

United States Patent [19]

Kim

[11] Patent Number: 5,937,226

[45] Date of Patent: Aug. 10, 1999

[54] DEVELOPING UNIT HAVING A PREHEATING APPARATUS

[75] Inventor: Yong Geun Kim, Suwon, Rep. of Korea

[73] Assignee: Samsung Electronics Co., Ltd, Suwon, Rep. of Korea

[21] Appl. No.: 08/908,561

[22] Filed: Aug. 8, 1997

[30] Foreign Application Priority Data

Aug. 8, 1996 [KR] Rep. of Korea ..... 96/33005

[51] Int. Cl.[6] ..... G03G 15/00

[52] U.S. Cl. ..... 399/44

[58] Field of Search ..... 399/94, 44, 97

[56] References Cited

U.S. PATENT DOCUMENTS

T956,001 3/1977 Kasper et al. .
4,027,621 6/1977 Kane et al. .
5,066,988 11/1991 Miyake .
5,247,334 9/1993 Miyakawa et al. .
5,436,104 7/1995 Yasuda et al. .
5,574,547 11/1996 Denton et al. .
5,832,332 11/1998 Sugiura ..... 399/44
5,862,433 1/1999 Regelsberger et al. ..... 399/44

*Primary Examiner*—S. Lee
*Attorney, Agent, or Firm*—Robert E. Bushnell, Esq.

[57] ABSTRACT

A developing unit having a preheating apparatus capable of ensuring good quality of printing by providing a preheating apparatus inside of a developing unit which stores a toner and maintains the toner at a predetermined temperature and humidity, includes: a toner storage unit for storing toner; a toner supply roller for supplying the toner; a photoconductive unit; a developing roller for transmitting the toner supplied by the toner supply roller to an electrostatic latent image formed on a surface of the photoconductive unit; a main body having the toner storage unit, the toner supply roller, the developing roller and the photoconductive unit; and a preheating unit disposed inside of the toner storage unit for properly maintaining the temperature of the toner.

20 Claims, 4 Drawing Sheets

DEVELOPING UNIT HAVING A PREHEATING APPARATUS

BACKGROUND OF THE INVENTION

1. Field of the Invention

The present invention relates to a developing unit having a preheating apparatus, and more particularly, to an improved developing unit having a preheating apparatus capable of ensuring good quality of printing by providing a preheating apparatus inside of a developing unit which stores a toner and maintains the toner at a predetermined temperature and humidity.

2. Description of the Related Art

In an earlier electrophotographic image forming device which is used in a duplicating apparatus and in a laser printer, when the surface of an organic photoconductive drum (OPC) is evenly charged by a corona discharge of a charging unit, an electrostatic latent image is formed on the charged surface of the OPC drum by exposure. The electrostatic latent image is changed into a visible image after it is developed by a toner when it passes a developing unit, and the visible image is transferred onto a paper by a transfer unit.

A transferred visible image is fixed on the paper by the heat and pressure of a thermal roller and a press roller when the paper passes the fixing unit. Small amounts of toner and the electrostatic latent image remain on the surface of the OPC drum, passing the transfer unit. The toner is removed by a cleaner, and the latent image is removed by a latent image removing lamp.

First, developing is performed when the toner sticks to the electrostatic latent image formed on the surface of the OPC drum. That is, in the case of a printer using an electrophotographic image forming method, as light from a laser beam or a light emitting diode LED is modulated according to the printing data received by the printer from a computer and the OPC drum is exposed, the electrostatic latent image, i.e., an electrical image similar to an image to be printed is formed on the surface of the OPC drum. At this time, the toner inside of the developing unit selectively sticks to the electrostatic latent image formed on the surface of the OPC drum by the operation of the electrical and physical power.

When the developing is completed through the above-described process, the toner on the surface of the OPC drum is transferred onto the paper by the electrical operation and the toner is fused to the paper by heat and pressure. The toner used in the electrophotographic image forming device is dependent upon the temperature and humidity of the circumferential factors. For example, after the electrophotographic image forming device is not used for a long time and is left at a low temperature and low humidity, when the device is used again, as the developing characteristic of the toner have already changed due to the circumferential factors of low temperature and low humidity, these factors may result in a printed image of poor quality.

U.S. Pat. No. 4,027,621, to Kane et al., entitled *Developing System For electrostatic Reproduction Machines*, discloses a developing apparatus for electrostatic copier having a heating means to heat the toner so as to have a proper temperature and humidity.

The defensive publication of Kasper et al., Defensive Publication No. T956,001, entitled *Electrographic Apparatus And Process For Humidity Stabilized Development*, discloses an electrophotographic apparatus including a heat generating to heat the toner so as to maintain its proper humidity. The patent to Denton et al., U.S. Pat. No. 5,574,547, entitled *Liquid Electrophotographic Reproduction Machine Employing Heated Carrier Liquid*, discloses a liquid electrophotographic apparatus in which the liquid toner is preheated to a desired temperature.

The following patents each disclose features in common with the present invention but are not as pertinent as the patents discussed in detail above: U.S. Pat. No. 5,247,334 to Miyakawa et al., entitled *Image Formation Method And Apparatus With Preheating And Pressure Image Transfer With Liquid Toner Development*, U.S. Pat. No. 5,066,988 to Miyake, entitled *Electrophotographic Apparatus Having Means For Avoiding Blurring Effects Caused By Idle Intervals*, and U.S. Pat. No. 5,436,104 to Yasuda et al., entitled *Method Of Forming Fixed Images Using Heated Belt.*

While each of the above-noted patents have features in common with the present invention, none of them teaches or suggests the specifically recited combination of elements of the present invention.

SUMMARY OF THE INVENTION

Therefore, it is an object of the present invention to improve the quality of the printed image by preventing the change of developing characteristic of the toner through maintaining a proper temperature and humidity of the toner regardless of the surrounding factors.

To achieve the above-mentioned object, a developing unit of an electrophotographic image forming device according to the present invention includes a toner storage unit for storing toner; a toner supply roller for supplying the toner; a photoconductive unit; a developing roller for transmitting the toner supplied by the toner supply roller to an electrostatic latent image formed on a surface of the photoconductive unit; a main body having the toner storage unit, the toner supply roller, the developing roller and the photoconductive unit; and a preheating unit placed inside of the toner storage unit for properly maintaining the temperature of the toner.

The preheating unit includes a heating unit; a sensing unit for sensing the temperature of the toner; a control unit for controlling the heating unit according to the temperature sensed by the sensing unit; and a heat transfer unit for fixing the heating unit and the sensing unit inside of the toner storage unit and for transferring the heat generated from the heating unit to the toner and the sensing unit.

The sensing unit is a sensing element which has different resistance values according to the sensed temperature, and more preferably, is a thermistor. The heating unit is a heating element which has different heating value according to the resistance value of the thermistor, and more preferably, includes a transistor. Moreover, the sensing unit includes a variable resistance for controlling the voltage supplied to a transistor and a Zener diode for setting a standard heating voltage of the transistor.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the following discussion of the preferred embodiments referring to the attached drawings.

Figure 1:
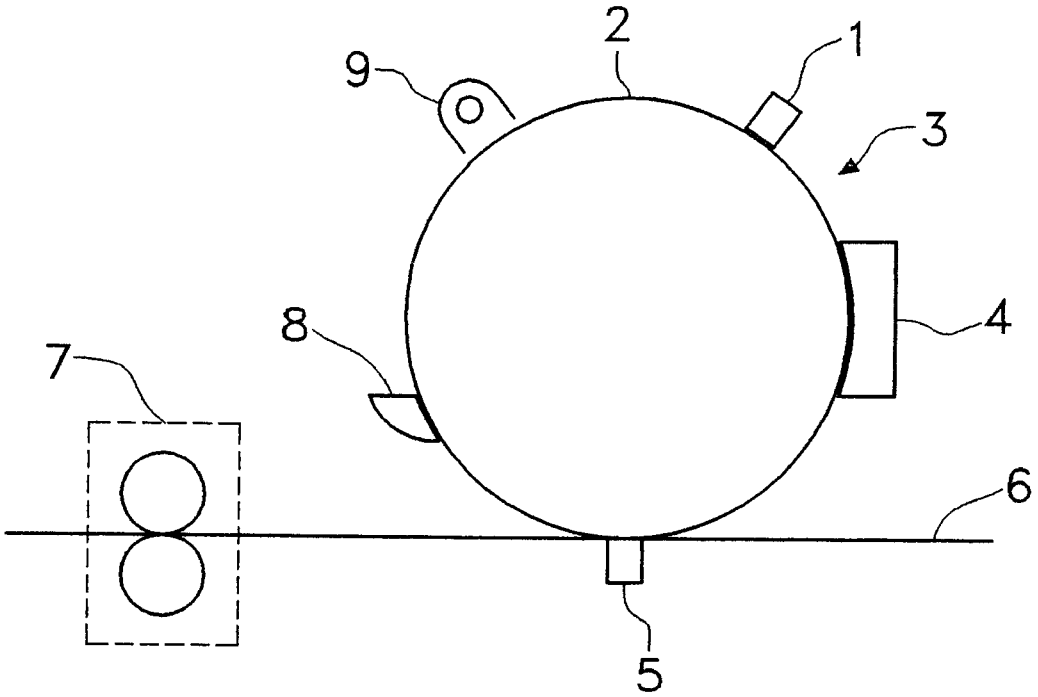
FIG. 1 is a view showing a construction of electrophotographic image forming device.

FIG. 1 illustrates an earlier electrophotographic image forming apparatus as discussed in the Description of the Related Art above.

A drum 2 is evenly charged by a corona discharge of a charging unit 1. An electrostatic latent image is formed on the charged surface of the drum 2 by exposure and is changed into a visible image after it is developed by a toner when it passes a developing unit 4 and the visible image is transferred onto a paper 6 by a transfer unit 5. The remaining toner which is not fixed to the paper by the heat and pressure of a thermal roller and a press roller of the fixing unit 7 is removed by a cleaner 8 and a latent image removing lamp 9.

Figure 2:
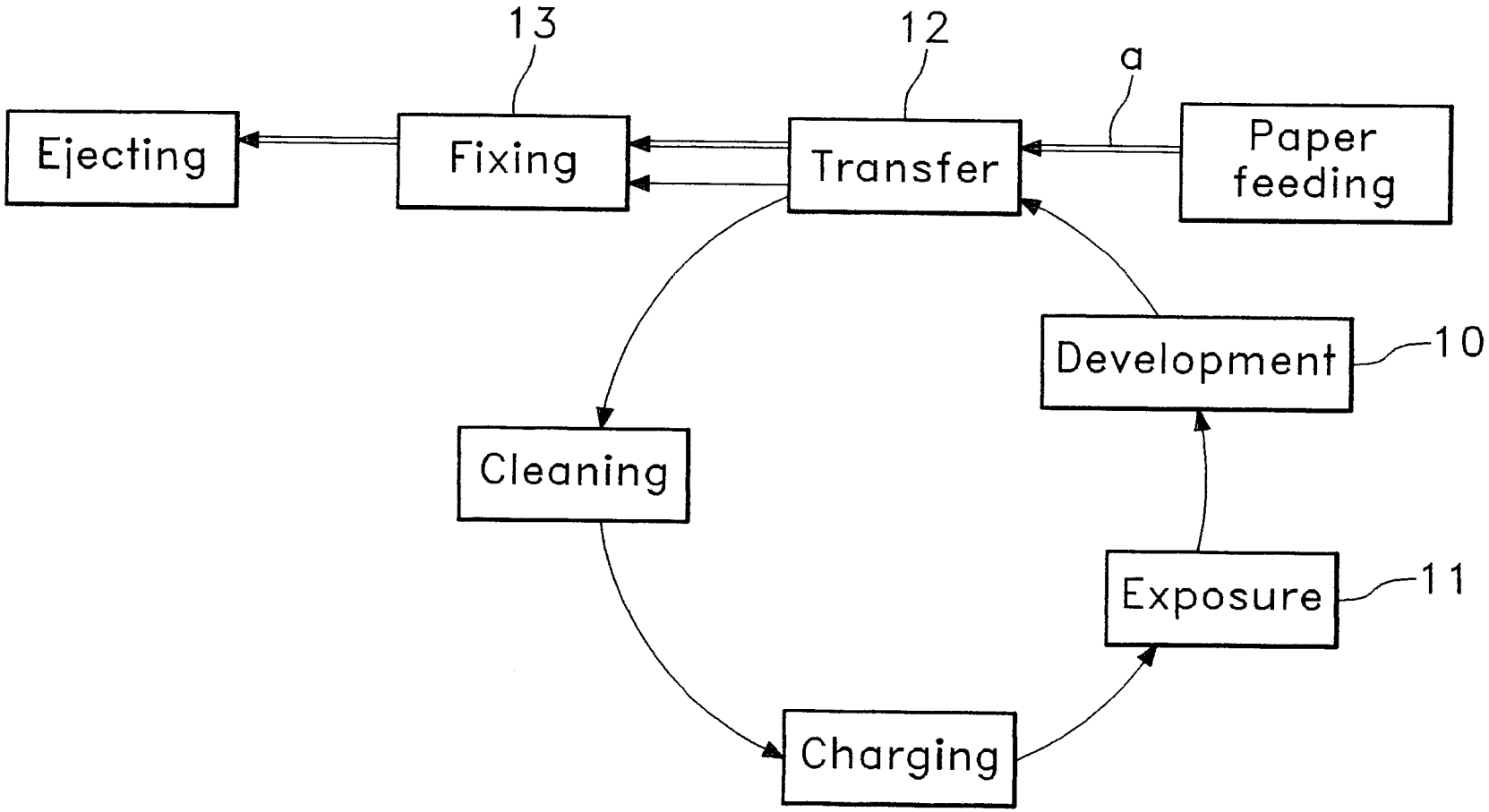
FIG. 2 is a block diagram showing a printing process of the electrophotographic image forming device.

FIG. 2 is self explanatory and illustrates the operation of the electrophotographic image forming device of FIG. 1.

Figure 3:
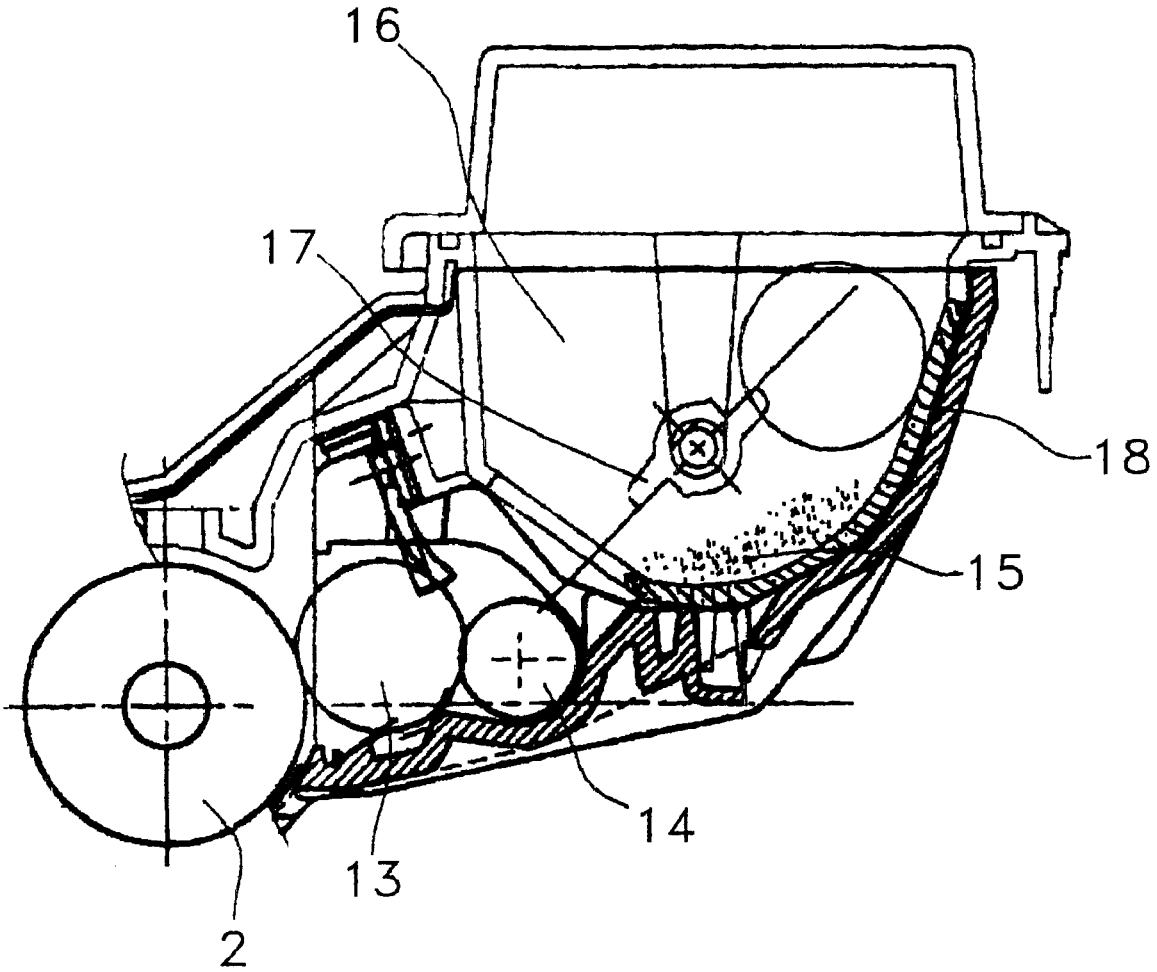
FIG. 3 is a sectional view of a developing unit having a heat conductive plate according to the present invention.

FIG. 3 is a sectional view of a developing unit having a heat conductive plate according to the present invention. As shown in the drawing, a developing roller 13 is located on the surface of an organic photoconductive (OPC) drum 2. A toner supply roller 14 is in contact with the developing roller 13, and an agitator 17 is provided inside of a toner storage unit 16 where toner is piled up to prevent toner powder from being clogged at one place. Moreover, a heat conductive place 18 is located at the facing side of the toner 15 which piled up inside of the toner storage unit 16.

The order for supplying the toner 15 to the electrostatic latent image on the surface of the OPC drum is as follows. First, when the electrophotographic image forming device is turned on after being left for a long time in a low temperature and low humidity, the heat conductive plate 18 provided inside of the toner storage unit 16 is heated and the toner is preheated. The toner 15 inside of the toner storage unit 16 having a proper temperature is continuously transferred to the developing roller 13 by the toner supply roller 14. The developing roller 13 transfers the toner 15 to the electrostatic latent image formed on the OPC drum 2.

Figure 4:
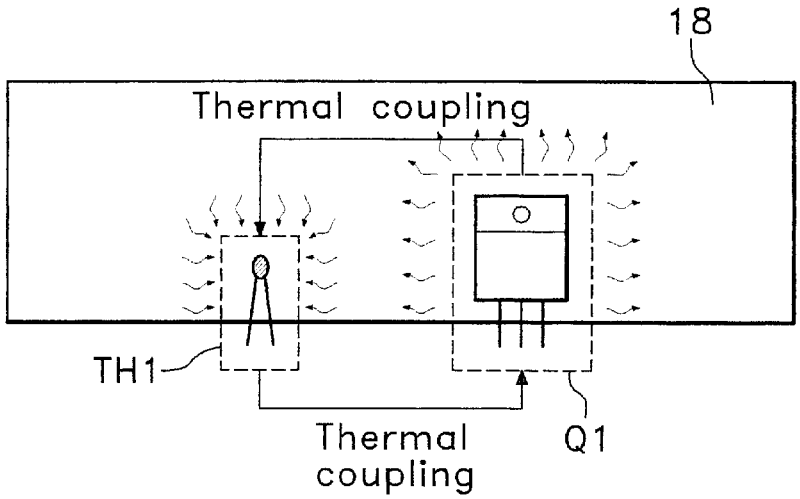
FIG. 4 shows conceptually a construction of the heat conductive plate according to the present invention.

Referring to FIG. 4, the method for properly maintaining the temperature of the toner 15 inside of the toner storage unit 16 is explained in detail. First, as shown in the drawing, a thermistor TH1 used as a sensing unit for sensing the temperature of the toner 15 and a transistor Q1 used as a heating unit are provided on the heat conductive plate 18. When power is supplied to the electrophotographic image forming device, the thermistor TH1 senses the temperature of the toner 15 through the heat conductive plate 18 and transmits the information on the sensed temperature to a control unit (not shown). The control unit heats the transistor Q1 and raises the temperature of the toner 15. After the temperature is raised by the heat of the transistor Q1, this temperature change is transferred to the thermistor TH1 and the resistance of the thermistor TH1 is changed. Accordingly, the control unit turns off the transistor Q1 and prevents the temperature from being raised any more. As shown above, the temperature of the toner 15 is properly maintained by maintaining the temperature of the heat conductive plate 18 through the correlation between the thermistor TH1 and the transistor Q1.

Figure 5:
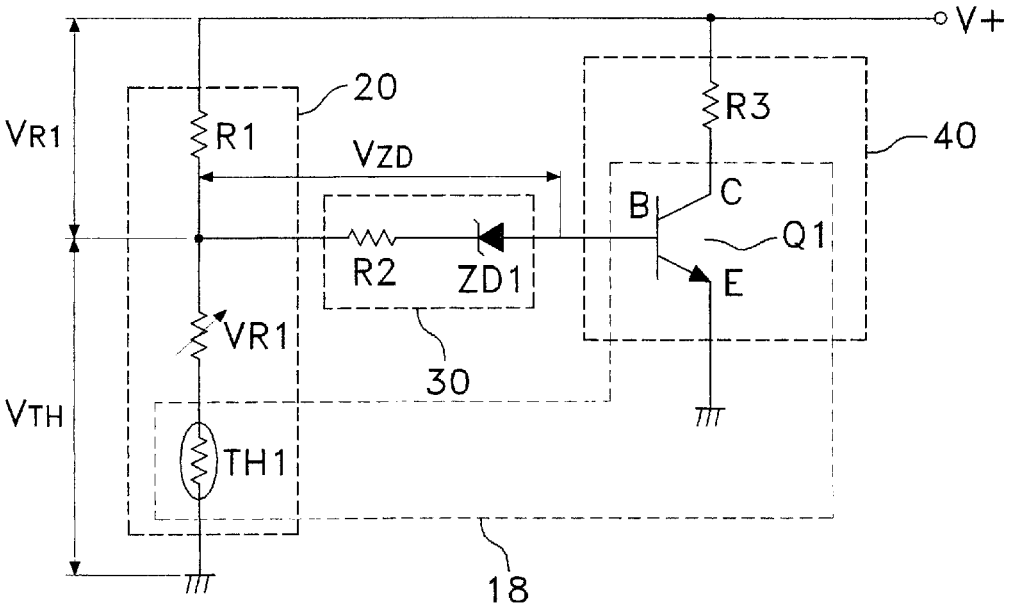
FIG. 5 shows a thermostatic circuit according to the present invention.

Referring to FIG. 5, there is shown a thermostatic circuit. In the drawing, R1 indicates a resistance, VR1 indicates a variable resistance for setting a heating temperature, and TH1 indicates a thermistor. These elements are serially connected and form a sensing unit 20 for sensing the temperature of the toner 15 through the heat conductive plate 18 caused by the heat generated from the transistor Q1. Also, R2 and R3 indicate resistances, ZD1 indicates a Zener diode, and Q1 indicates a transistor. The resistance R2 and the Zener diode ZD1 form a control unit 30, and the resistance R3 and the transistor Q1 form a heating unit 40. C of the transistor Q1 indicates a collector, E indicates an emitter, and B indicates a base.

The operation of the above-described circuit is as follows. The formula for calculating the resistance value of the thermistor TH1 at an optional temperature is as follows.

$$R=R_0X \exp\{B\,X(1/T-1/T_0)\}[\Omega] \quad (1)$$

where, B indicates a resistance coefficient according to the temperature of the thermistor TH1 and T indicates an absolute temperature [K] sensed from the heat conductive plate 18. $T_0$ is a standard temperature, and is an absolute temperature of 25° C., i.e., 298.15K. Accordingly, a resistance R[Ω] of the thermistor TH1 according to the temperature sensed from the heat conductive plate 18 is calculated by using formula 1. The heating value of the transistor Q1 is varied according to the value of the resistance R[Ω].

The sum of voltage $V_{TH}$ which is applied to serially combined resistance of the thermistor TH1 and the variable resistance VR1 for setting the standard heating temperature, and the voltage $V_{R1}$ which is applied to resistance R1 is equal to an applied voltage V+. The sum of voltage $V_{ZD}$ which is applied to resistance R2 and the Zener diode ZD1, and voltage $V_{BE}$ between the base B and the emitter E is equal to the voltage $V_{TH}$.

The voltage $V_{ZD}$ is amplified by the transistor Q1, and as the voltage $V_{ZD}$ increases, the collector current $I_C$ increases. As the heat is generated by the thermal loss of the transistor Q1 caused by the current $I_C$ flowing in the collector C and the voltage $V_{CE}$ between the collector C and the emitter E, the thermal loss $P_D$ of the transistor Q1 is a product of voltage and current, and it is shown by the following formula.

$$P_D=I_C\cdot V_{CE}[W] \quad (2)$$

Accordingly, in the case of using a thermistor TH1 having a resistance value which lowers as the temperature rises, when the temperature of the heat conductive plate 18 is low, the resistance value of the thermistor TH1 is increased, and the voltage $V_{TH}$ is also increased. As the collector current $I_C$ is increased, the transistor Q1 starts heating. Moreover, when the temperature of the thermistor TH1 rises due to the heat from the heat conductive plate 18, as the resistance value becomes small and the voltage $V_{TH}$ is decreased, the collector current $I_C$ is decreased and the heating value of the transistor Q1 is also thereby decreased.

That is, when the temperature of the heat conductive plate 18 is above a predetermined temperature, the voltage $V_{TH}$ is lowered as the resistance of the thermistor TH1 is decreased.

Accordingly, the voltage applied to the Zener diode ZD1 is below a predetermined voltage level and a current does not flow, thereby cutting off the heating of the transistor Q1. On the contrary, when the temperature of the heat conductive plate 18 is lowered and a voltage above a predetermined voltage is applied to the Zener diode, the transistor Q1 starts heating. Accordingly, the proper temperature of the heat conductive plate 18 can be obtained by using the correlation between the variable VR1 and the Zener diode ZD1.

As described above, according to the developing unit having a preheating apparatus of the present invention, as the heating of the transistor is controlled by the thermistor according to the temperature and humidity in the thermostatic circuit having a variable resistance, the temperature of the toner is always properly maintained, thereby preventing a printed image of poor quality.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A developing unit of an electrophotographic image forming means, comprising:

a toner storage means for storing toner;

a toner supply roller for supplying the toner;

a photoconductive means;

a developing roller for transmitting the toner supplied by said toner supply roller to an electrostatic latent image formed on a surface of said photoconductive means;

a main body having said toner storage means, said toner supply roller, said developing roller and said photoconductive means contained therein; and a preheating means disposed inside of said toner storage means for properly maintaining a temperature of the toner;

said preheating means comprising:

a heating means for heating the toner;

a sensing means for sensing the temperature of the toner due to the heat generated by said heating means;

a control means for controlling said heating means according to the temperature sensed by said sensing means; and a heat transfer means for fixing said heating means and sensing means inside of said toner storage means and for transferring the heat generated from said heating means to the toner and said sensing means; said sensing means comprising a sensing element which has continuously varying different resistance values according to the sensed temperature.

2. The unit of claim 1, said sensing means comprising a thermistor.

3. The unit of claim 1, said heating means comprising a heating element which has a different heating value according to the resistance value of the sensing means.

4. The unit of claim 2, said heating means comprising a heating element which has a different heating value according to the resistance value of the sensing means.

5. The unit of claim 1, said heating means comprising a transistor.

6. The unit of claim 2, said heating means comprising a transistor.

7. The unit of claim 3, said heating means comprising a transistor.

8. The unit of claim 4, said heating means comprising a transistor.

9. The unit of claim 1, said sensing means comprising a variable resistance for controlling voltage supplied to said heating means; and a Zener diode for setting a standard heating voltage of said heating means.

10. The unit of claim 2, said sensing means comprising a variable resistance for controlling voltage supplied to said heating means; and a Zener diode for setting a standard heating voltage of said heating means.

11. The unit of claim 3, said sensing means comprising a variable resistance for controlling voltage supplied to said heating means; and a Zener diode for setting a standard heating voltage of said heating means.

12. The unit of claim 4, said sensing means comprising a variable resistance for controlling voltage supplied to said heating means; and a Zener diode for setting a standard heating voltage of said heating means.

13. The unit of claim 5, said sensing means comprising a variable resistance for controlling voltage supplied to said heating means; and a Zener diode for setting a standard heating voltage of said heating means.

14. The unit of claim 6, said sensing means comprising a variable resistance for controlling voltage supplied to said heating means; and a Zener diode for setting a standard heating voltage of said heating means.

15. The unit of claim 7, said sensing means comprising a variable resistance for controlling voltage supplied to said heating means; and a Zener diode for setting a standard heating voltage of said heating means.

16. The unit of claim 8, said sensing means comprising a variable resistance for controlling voltage supplied to said heating means; and a Zener diode for setting a standard heating voltage of said heating means.

17. A developing unit of an electrophotographic image forming means, comprising:

a toner storage means for storing toner;

a toner supply roller for supplying the toner;

a photoconductive means;

a developing roller for transmitting the toner supplied by said toner supply roller to an electrostatic latent image formed on a standard a surface of said photoconductive means;

a main body having said toner storage means, said toner supply roller, said developing roller and said photoconductive means contained therein; and a preheating means disposed inside of said toner storage means for properly maintaining a temperature of the toner;

said preheating means comprising:

a heating means comprising a transistor for heating the toner;

a sensing means for sensing the temperature of the toner due to the heat generated by said heating means;

a control means for controlling said heating means according to the temperature sensed by said sensing means; and a heat transfer means for fixing said heating means and sensing means inside of said toner storage means and for transferring the heat generated from said heating means to the toner and said sensing means; said sensing means comprising a sensing element which has varying different resistance values according to the sensed temperature.

18. The unit of claim 17, said sensing means comprising a thermistor.

19. The unit of claim 17, said sensing means comprising a variable resistance for controlling voltage supplied to said heating means; and a Zener diode for setting a standard heating voltage of said heating means.

20. The unit of claim 18, said sensing means comprising a variable resistance for controlling voltage supplied to said heating means; and a Zener diode for setting a standard heating voltage of said heating means.

* * * * *